United States Patent [19]

Frederiksen

[11] Patent Number: 4,582,961

[45] Date of Patent: Apr. 15, 1986

[54] CAPACITIVE TRANSDUCER

[75] Inventor: Erling Frederiksen, Holte, Denmark

[73] Assignee: Aktieselskabet Brüel & Kjar, Denmark

[21] Appl. No.: 439,291

[22] Filed: Nov. 4, 1982

[30] Foreign Application Priority Data

Nov. 13, 1981 [DK] Denmark ..... 5024/81

[51] Int. Cl.[4] ..... H04R 9/00; H04R 1/02

[52] U.S. Cl. ..... 179/111 R; 179/179; 310/308

[58] Field of Search ..... 179/111 R, 111 E, 115 R, 179/121 R, 138, 179; 310/308

[56] References Cited

U.S. PATENT DOCUMENTS

| | | | |
|---|---|---|---|
| 2,787,671 | 4/1957 | Grosskopf et al. | 179/111 R |
| 3,418,436 | 12/1968 | Neumann | 179/111 R |
| 3,436,492 | 4/1969 | Reedyk | 179/111 R |
| 3,946,422 | 3/1976 | Yagi et al. | 179/111 E |
| 4,321,432 | 3/1982 | Matsutani et al. | 179/111 R |
| 4,447,678 | 5/1984 | Fidi | 179/111 R |

*Primary Examiner*—Gene Z. Rubinson
*Assistant Examiner*—Danita R. Byrd
*Attorney, Agent, or Firm*—Cushman, Darby & Cushman

[57] ABSTRACT

A capacitor transducer, for instance a condenser microphone, is so designed that the stationary electrode can be mounted relatively quickly and in a relatively simple manner in the microphone housing. The transducer is provided with an inner cylindrical supporting wall spaced from the inner surface of the transducer housing. One end of the supporting wall is fixedly connected to the transducer housing through a transverse wall while the other end is remote from the transverse wall and constitutes a seat for the insulating body. The supporting wall in the insulating body are so dimensioned that the body can be mounted into its seat either by a pressing action or by insertion and subsequent retention by means of frictional forces or by means of an adhesive.

14 Claims, 7 Drawing Figures

Fig. 1
(PRIOR ART)
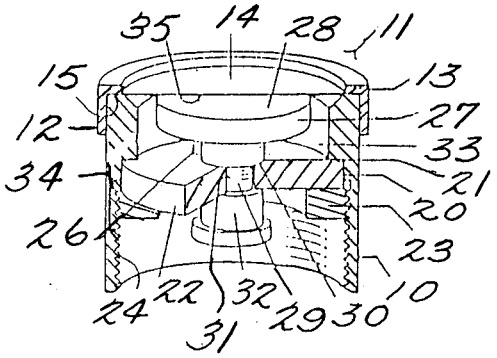
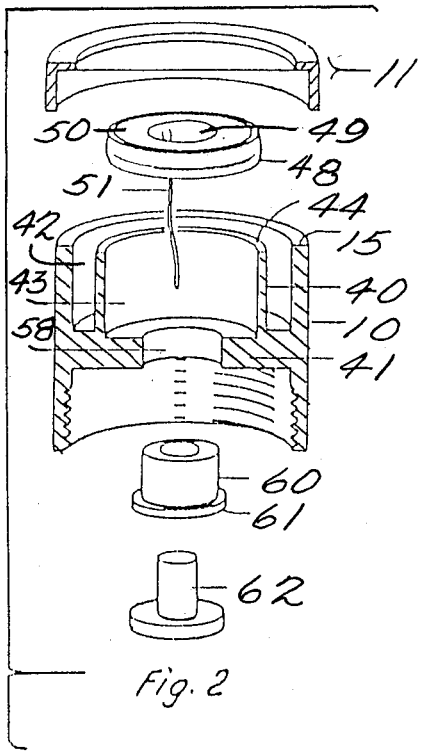
Fig. 2

CAPACITIVE TRANSDUCER

BACKGROUND OF THE INVENTION

1. Field of Invention

The invention relates to a capacitive transducer of the type comprising a metallic transducer-housing having two electrically conducting plates mounted thereon or therein, one of which constitutes a stationary electrode and the other one of which constitutes an electrode which is movable relative to the stationary one. The movable electrode is mounted at the end of the transducer housing, while the stationary electrode is mounted on an insulating body secured in the interior of the transducer housing and there supports the stationary electrode at a small distance from the said movable electrode.

2. Description of the Prior Art

A transducer of the above mentioned kind may be, for example a condenser microphone. The invention is of major importance in connection with condenser microphones of a certain quality such as studio microphones or measurement microphones. All measurement microphones are, with very few exceptions, designed as condenser microphones because the design concept for this kind of microphone, more than all other principles, makes it possible to meet the overall requirements which should be met by high-quality measurement microphones. A primary requirement is that the acoustical performance of the microphone is good in order to achieve great accuracy of measurement. It is further necessary that its sensitivity to variations in the environment such as pressure, temperature and humidity is low.

In order to obtain reproducible results and to prolong the intervals between necessary calibrations it is also imperative that the microphone exhibits short-term as well as long-term stability. Further, it should be possible to carry out the calibration in a simple manner, to readily verify its sensitivity and frequency response and to predict its performance not only by means of direct measurements but also by means of calculations based on theoretical considerations which can give an independent confirmation of the data measured.

Condenser microphones for measurement purposes or studio use are commonly made up of mechanical elements which are assembled or joined together by means of threads. These parts or elements form essentially cylindrical structural members which at convenient places are provided with the proper threadings or tappings. The main elements of a condenser microphone are a stationary electrode, also called a backplate, and a movable electrode embodied as a diaphragm which, when at rest, is kept at a well defined distance from the backplate. These two electrodes constitute the parallel plates of a capacitor employing ordinary atmospheric air as the dielectric. The stationary electrode or backplate is screwed to a relatively thick disc of a highly insulating and dimensionally stable material. The disc-shaped insulator is clamped to the inner surface of a tubular microphone-housing of for instance Monel ®, titanium or German silver. A stretched foil or diaphragm, which in high-quality transducers is made of metal or metal alloys, is mounted at the end of the microphone housing. This foil or diaphragm constitutes the movable electrode. The microphone housing, insulator and diaphragm form a closed compartment. The occurrence of a pressure difference between the outer atmosphere and the closed compartment causes the diaphragm to be moved or displaced which movement or displacement causes a change of capacity which can be measured electrically. The frequency response of the microphone is determined essentially by the resonance point of the diaphragm and by its damping. The resonance frequency is determined by the mass of the diaphragm and by its mechanical tension. The damping depends on the mobility of the air in the space between the diaphragm and the backplate, and therefore it can be varied partly by choosing an appropriate geometry for the backplate and partly by choosing an appropriate distance between the diaphragm and the backplate.

Because variations in atmospheric pressure vastly exceed the small pressure variations originating in the propagation of sound, at least one pressure equalization vent leading from the closed compartment to the outer atmosphere is provided. The internal diameter of the vent and its length are so adapted that a pressure equalization from the outer atmosphere to the interior cavity of the microphone can take place at slow variations of the atmospheric pressure but prevents pressure equalizations at normally occurring sound frequencies. For the most commonly used types of microphones the lower cut-off frequency of the pressure equalization system ranges from 1 Hz to 10 Hz.

The function of the backplate, in addition to its serving as the stationary electrode of a capacitor, is to influence by its presence close to the diaphragm the movement or displacement of the diaphragm in order to achieve a desired frequency response.

In modern types of microphones, the distance between the electrodes typically ranges from 10 microns to 30 microns. For individual types the choosen distance must be within tolerances typically ranging from 2 to 5 percent, plus/minus, i.e. from 0.2 micron to 1.5 microns, if a suitably uniform damping of the diaphragm displacement in the region about the resonance frequency is to be obtained in practice. In this way the desired uniformity in frequency response and sensitivity of the microphone is obtained. The backplate influences the movement of the diaphragm by dissipating energy as the air in the narrow space between the stationary electrode and the movable electrode is pumped to and fro during the movement of the diaphragm. This damping of the diaphragm movement is usually controlled by the provision of a suitable number of properly sized holes in the backplate which lead from the narrow space between the electrodes to the rear surface of the stationary electrode within the closed compartment of the microphone. For a given type of microphone it is in this way possible to achieve a desired damping factor for the movements of the diaphragm.

In order to make it possible to manufacture microphones which under the most varied environmental conditions operate in a stable manner, i.e. without changing their characteristics, it is of the utmost importance that during the design process care is taken in selecting materials and to ensure that the necessary accuracy of manufacture is established for the individual structural members or bodies.

For long-term stability the materials have to exhibit initial stability. With respect to the insulator a further requirement is made. For measurements at low frequencies the insulator should be made of a highly insulating material implying in practice that ceramics, glass, sapphire, quartz or related materials should be used. Such materials typically have a very low thermal coefficient of linear expansion, a coefficient differing very much from that of metals. This is of importance because the other structural members of the microphone are made of matched metals or their alloys. This may influence the microphones temperature coefficient resulting in sudden changes in the microphones sensitivity during changes in the ambient temperature.

The sensitivity of a condenser microphone is directly proportional to the distance between the electrodes. With the above mentioned figures in mind an inaccuracy in the distance between the electrodes of 0.2 micron results typically in a deviation of 1% from the desired or nominal sensitivity which for certain purposes is unacceptable.

Additonally, the sensitivity of a condenser microphone is inversely proportional to the inner tension of the diaphragm. As this tension is dependent on the extension of the foil it has to be fixed relative to the microphone housing in a well-defined manner.

In the manufacture of high-quality microphones metals are generally used for the diaphragm and the microphone housing. The thermal coefficient of linear expansion of the metals employed ranges from $8\times19^{-6}$ per degree centigrade to $22\times10^{-6}$ to per degree centigrade. In good designs materials having a mutual difference in thermal coefficient substantially below $1\times10^{-6}$ per degree centigrade are selected. This is a necessary measure because the extension of the foil resulting in the desired tension of the membrane only amounts to a few microns. Therefore, an extension of the foil caused by the temperature has to be compensated for by a corresponding expansion of the microphone housing. An important problem of the prior art microphones is that the observance of the necessary tolerances for the distance between the electrodes implies an extensive manufacturing process involving many different time-consuming processes. As examples hereon one may mention plane or surface grinding, machine lapping and simultaneous polishing or finishing of the microphone housing and the bakcplate because those members cannot be manufactured individually with the required tolerances. These processes ensure the parallel relationship between the reference plane of the diaphragm constituted by the diaphragm's abutment surface on the microphone housing and the stationary electrode. Other working processes may be mentioned such as mechanical separation of parts, trimming, buffing and cleaning and subsequently a final assembling which is time-consuming because the correct distance between the electrodes is ensured by the insertion of very thin adjusting washers either between the movable electrode and its abutment surface on the microphone housing or between the insulator disc and its abutment surface on the housing.

Additionally, a further problem occurs in that the insulator material exhibits a thermal coefficient of linear expansion which differs substantially from those of metals. It is therefore necessary to mount the insulating disc in such a way that the microphone housing at the location in which the diaphragm is secured remains uninfluenced by the much lesser expansion of the insulator. In prior art microphones this is achieved by so fitting the insulating disc in the microphone housing that these two members can slide mutually on contiguous surfaces which are perpendicular to the longitudinal axis of the microphone, and the same measure is provided for the mounting of the backplate on the insulating disc. This mounting or assembling procedure results, depending on the practical workmanship, in a risk for discontinuous changes of the sensitivity.

SUMMARY OF THE INVENTION

According to the present invention, there is provided a capacitive transducer of the kind mentioned in the opening paragraph of this specification in which a substantially cylindrical supporting wall member is provided in the interior of the transducer housing, spaced from the inner surface of the housing, one end of which supporting wall member is securely connected to the transducer housing through a transversal wall or bottom member and the opposite end of which, being remote from the transversal wall or bottom member, constitutes a seat for the insulating body, and in which the supporting wall member and the insulating body further are dimensioned to enable the insulating body to be mounted in its seat by a pressing or inserting action and finally be retained in its seat either by friction forces or by means of an adhesive, respectively.

A number of advantages are obtained by the features stated above. Firstly, it is now possible to place by a simple and inexpensive procedure, the insulating disc on which the back-electrode is placed with the aid of a precision piston or a precision mandrel so that the position of the stationary electrode in the axial direction of the housing can be determined with extreme accuracy with respect to a predetermined reference plane or level which is also utilized when positioning the movable electrode. Besides being very accurate this method is far more inexpensive than the method employed hitherto. Secondly, the parts of the microphone can be manufactured separately with the required accuracy so that an expensive finishing work on the parts, by which they are finished in pairs or sets for mutual adaptation, is rendered superfluous.

The supporting wall member and the insulating disc are so dimensioned relative to each other that the circumference of the end of the wall member remote from the transversal wall or bottom member is given a resilient expansion during the insertion of the disc, which is so large that the disc retaining forces remain substantially unchanged irrespective of differences in the materials' thermal coefficient of linear expansion within the range of temperature in which the transducer in question is disposed to operate. The thermal expansion of that end of the supporting wall which forms the seat of the insulating disc will follow the expansion of the disc, whereas the opposite end of the wall which is secured to the remaining part of the transducer housing and additionally is made of substantially the same material expands in accordance with the larger coefficient of linear expansion of the metals or alloys in question. The stresses resulting therefrom cause a resilient deformation of the thin supporting wall but leave the remaining parts of the transducer housing uninfluenced.

A capacitive transducer of the type mentioned above is, according to the invention, further characterized in that the stationary electrode and the insulating body are provided as an integral unit shaped like an insulating disc having a unilateral electrically conducting coating, or alternatively, in that the stationary electrode is mounted as a separate body on a disc of an electrically insulating material.

To ensure the stationary electrode is not displaced axially, i.e. to ensure a predetermined distance between the electrodes is maintained, when the insulating disc is to be retained in its seat by means of frictional forces, the outer cylindrical surface of said insulating disc facing the inner surface of the supporting wall member is preferably provided with a convex surface and is so profiled that a narrow surface engaging the inner surface of the supporting wall member is provided, which engaging surface exhibits mirror symmetry about a plane which is normal to the axis of the transducer and which includes a maximum diameter of the insulating disc. The disc is further placed so deep in its seat that a projection on a plane of those forces which can influence on the disc in an axial direction balance out each other. The above mentioned design of the disc additionally facilitates its insertion into the cylinder entrance or into the seat.

BRIEF DESCRIPTION OF THE DRAWING

A capacitive transducer according to the present invention will now be described with reference to the accompanying drawings, in which:

FIG. 1 is a perspective and partly sectional view of a condenser microphone belonging to the prior art;

FIG. 2 is an exploded perspective view of a condenser microphone according to the present invention, with some of the structural members shown in a vertical, longitudinal section;

DESCRIPTION OF THE PREFERRED EMBODIMENTS

Figure 3:
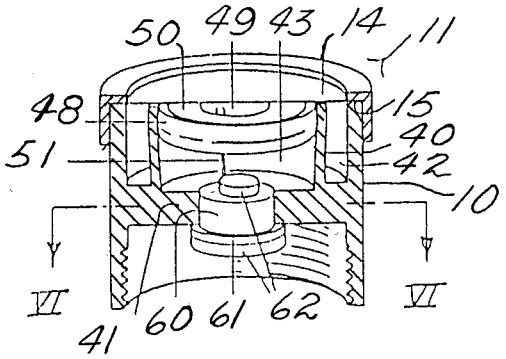
FIG. 3 is similar to FIG. 2, the parts, however, being assembled.

The prior art embodiment of a condenser microphone shown in FIG. 1 comprises an outer microphone housing 10 shaped substantially like a cylindrical structural member. The microphone housing 10 is in its upper end on the drawing mounted with a diaphragm unit referred to in general by reference numeral 11. The diaphragm unit comprises a short cylindrical sleeve 12 having a flange 13 which in cooperation with the microphone housing supports a membrane or diaphragm 14. This diaphragm, which in high-quality microphones usually is made of a foil of a choice metal or an alloy of such metals but also of a metal-coated foil, constitutes the movable electrode of the microphone. The diaphragm unit 11 is screwed on the microhone housing 10 or secured thereon in any other way so that an electrically conductive connection is established between the housing 10 and the diaphragm 14. The microphone housing 10 terminates at its upper end in the drawing in a horizontal, annular abutment surface 15, which, when the diaphragm unit 11 is screwed on, abuts the inside of the diaphragm 14 at the flange 13. The shaping of this abutment surface 15 is a very critical process as the matter of accuracy is concerned because this surface defines a reference plane for the positioning of the movable electrode on the one hand and the stationary one on the other, cf. the statements made in the opening paragraphs regarding the tolerances of the gap between the movable and the stationary electrodes.

The inner surface of the microphone housing 10 is provided with a recess 20 having an abutment surface 21 for a disc shaped insulator 22. The insulator is kept in position in the microphone housing 10 by means of a retaining ring 23 which is screwed in a thread 24 on the inner surface of the housing. The tightening of this retaining ring 23 has to secure the axial position of the insulator in order to prevent it from displacing itself in the longitudinal direction of the housing, permitting, however, minor displacing movements in the radially going abutting surfaces of the insulator and the microphone housing thus providing for compensation of the differences between the thermal coefficients of linear expansion of the materials.

A stationary electrode referred to in general by reference numeral 26, which in technical terms also is called the back electrode or the backplate, comprises a head 27 having a plane upper surface 28 which constitutes the real stationary capacitor plate, and a stem-shaped part 29 provided with a shoulder 30. The stem 29 is run through a hole 31 in the middle of the insulator 22 so that the shoulder 30 rests against the upper surface of the insulator and is kept in position by means of a screwed fastening sleeve 32 beneath the insulator. The clearance between the inner sides of the hole 31 and the stem 29 of the backplate is sufficient to compensate for differences in expansions of materials due to differing thermal coefficients of linear expansion for the various materials employed.

The diaphragm unit 11, microphone housing 10, backplate 26 and the insulator 22 confine an air space 33 which communicates with the ambient atmosphere only through a capillary tube dimensioned pressure equalization duct 34 provided in the microphone housing 10. Between the diaphragm 14 and the upper surface 28 of the backplate there exists a very narrow air gap 35 which constitutes the dielectric of the capacitor or condenser.

The sensitivity of a condenser microphone is as mentioned in the beginning of the present specification directly proportional to the distance between the electrodes and inversely proportional to the inner tension of the diaphragm. It was also mentioned that the tolerances of the 20 microns narrow air gap should be kept between 0.2 micron and 1.5 microns. Hence, from the above description of a prior art embodiment of a condenser microphone it is evident that the observance of the tolerances thus mentioned and inherently the meeting of requirements made on high-quality microphones involves time-consuming and consequently expensive processes during the manufacture of the various structural members of the microphone. The provision of the necessary planeness for the housing's abutment surface 15 for the diaphragm foil 14, which surface as mentioned above defines a reference surface, and for the upper surface 28 of the backplate, together with the ensuring of their parallel relationship with the diaphragm foil 14 involve so time-consuming processes as surface grinding, lapping and burnishing etc., cf. the statements made above.

Some embodiments of a condenser microphone according to the present invention will now be described, in which the problems sketched above have been solved more elegantly and above all in a substantially less expensive way.

In the following discussion there is referred collectively to the FIGS. 2 and 3. The figures are, like FIG. 1, simplified a great deal from reality that only the matters relevant for the understanding of the invention have been shown. The more detailed features which are irrelevant to the invention such as the placing of threads and the like have been omitted as this kind of information lies within the competence of the person with ordinary skill in the art.

The microphone housing 10 is in its new design still substantially cylindrical. Inside of the housing and spaced from its inner surface there is provided a substantially cylindrical supporting wall member 40 which is fastened to or extends from a transverse bottom wall 41 and divides the interior of the housing into an outer chamber 42 and an inner chamber 43. Essentially, the supporting wall member is provided coaxially with the microphone housing and may be made integrally with the bottom wall 41 or may be fixed thereto in any suitable manner. The radially oriented terminal surface 44 of the supporting wall member 40 is recessed relative to the microphone housing's abutment surface 15 for the diaphragm unit 11 which is designed similar to that described in connection with the prior art.

Unlike the prior art embodiment, the stationary electrode and the insulator of the new embodiment according to the invention are preferably designed as an integral unit. On the drawings there is shown a relatively thick disc-shaped insulator 48 having a central hole 49 and a thin, electrically conducting coating 50 on its upper surface. The coating constitutes the back electrode of the microphone. It may be made of a metal film which may be applied during a vaporizing process. During such a process the application angle may suitably be carried out under an angle different from 90 degrees with the effect that the electrode coating can spread itself down into the hole 49 in the insulator disc thus providing in a convenient manner a contacting area for the mounting of a connecting line or wire 51. The coating 50 does not completely reach the edge of the insulator disc 48, whereby there is established a suitable insulation between the electrodes when the microphone is assembled, cf. FIG. 3.

It appears from this figure that the insulator with applied back electrode is pressed into the open end of the supporting wall member 40 remote from the bottom wall 41. The insertion of the integrated unit can be done with great accuracy as the pressing action may be carried out with the aid of a specially designed precision mandrel ensuring the backplate 50 to be positioned with the necessary accuracy in a desired level below the diaphragm 14 as the housing's abutting surface 15 against the diaphragm 14 as mentioned above serves as a reference surface for the positioning of the stationary electrode.

Figure 4:
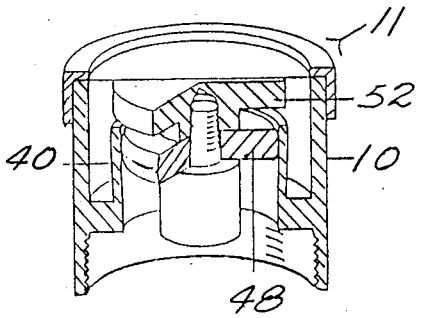
FIG. 4 is a perspective and partly sectional view of an alternative embodiment of a condenser microphone according to the present invention.

An alternative implementation of the present invention is illustrated in FIG. 4. Again, there is shown a microphone housing 10 onto which a diaphragm unit 11 is secured and having an inner supporting wall member 40 of the same kind as shown in FIGS. 2 and 3, at the end of which member 40 there is inserted an insulator disc 48 in exactly the same manner as shown in FIG. 3. According to the invention, the alternative measure is to be seen in that the stationary electrode is provided as a separate member 52 having a head and a stem and mounted on the insulator disc in a manner known per se and illustrated in FIG. 1. This feature implies the advantage that techniques more readily available can be used when designing the stationary electrode in detail because only a few works are in a position to machine the special materials of which the insulator disc is made, such as, quartz, sapphire, ruby and similar materials.

The supporting wall member 40 is so dimensioned, i.e. is given such a wall thickness and such an axial extension, that its free end can be slightly expanded during the insertion of the insulator disc 48 with its electrode coating applied or its electrode mounted thereon, respectively, so that the disc is retained in position by means of frictional forces acting between the inner surface of the supporting wall member 40 and the cylindrical, outer surface of the insulator disc 48. The disc and the wall member may alternatively be so dimensioned that the disc can just be inserted into the open end of the supporting wall member without radial deflection or extension of the wall. This measure requires, however, that the disc for instance is glued onto the supporting wall and during the gluing is kept in position by means of said precision mandrel or plug until the glue has cured or solidified. Besides, the dimensions of the supporting wall member have to be so adapted to the other dimensions of the housing 10 that the difference between the thermal expansion of the ends of the supporting wall member is equalized by flexing motions in the supporting wall so that the outer part of the microphone housing remains uninfluenced, cf. the above statements. Thus, sliding motions between contiguous structural members of customary designed microphones have been replaced by springing of the supporting wall, by which feature there is achieved, as mentioned above, the avoidance of possible sudden changes of the sensitivity which are known from the prior art microphones.

Figure 5:
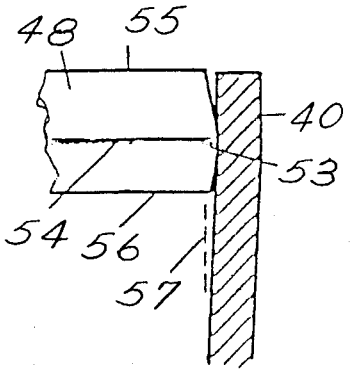
FIG. 5 is a vertical, longitudinal section of a detail shown in FIG. 3, shown in a larger scale.

The outer, cylindrical surface of the insulator disc 48, which faces the inner surface of the supporting wall member 40, may be convex-shaped such as illustrated in FIG. 5. The scale of this figure is five times the scale of FIG. 3. The disc 48 is so profiled in a diametrical section that there is provided a very narrow and symmetric engaging surface 53 between the disc 48 and the supporting wall member 40. The surface is made narrow in order to minimize a sliding motion between the two contiguous surfaces having the effect that the risk of axial displacements of the disc owing to fluctuating temperatures is reduced. The engaging surface 53 is made to exhibit mirror symmetry about a plane normal to the transducer axis which plane comprises a maximum diameter of the disc 48. It should be further noted that this plane does not necessarily lie equidistantly from the two end surfaces 55 and 56 of the disc. The reason why is that the supporting wall member 40 does not extend equally on either side of the insulator disc and that it is possible by a proper insertion depth to obtain with this profilation of the disc that the projection on a plane of those forces which may act on the disc in the axial direction are approximately equal on either side of said normal plane but oppositely directed. It is further insured by this measure that the stationary electrode is not moved due to temperature effects from its predetermined position. The convex shape further facilitates the insertion of the insulator disc. It should be noted that the figure applies to the case in which the disc is held by means of frictional forces without gluing. The deflection of the supporting wall from a stress-free position is shown by a dashed line 57.

Figure 6:
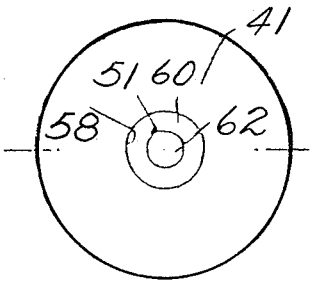
FIG. 6 is a horizontal section taken along the line VI—VI in FIG. 3.
Figure 7:
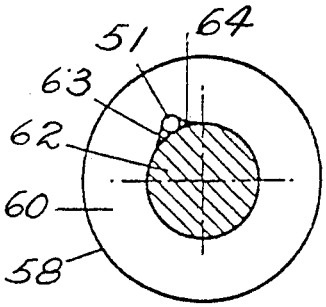
FIG. 7 is a detail in FIG. 6 shown in a larger scale.

In the above described embodiments of a transducer according to the invention, it is especially easy to provide a pressure equalization duct between the interior of the transducer housing and the ambient atmosphere. Besides the FIGS. 2 and 3, reference is made to the FIGS. 6 and 7. The scale of FIG. 7 showing a detail from FIG. 6 is three times the scale of the last-mentioned figure.

A bushing 60 of a resilient insulating material is run through a hole 58 in the transversal or bottom wall 41. The bushing abuts with a flange 61 at the lower surface of the bottom wall. The connecting wire 51 is run from the interior of the microphone through the bushing 60, whereas a plug 62 of an electrically conducting material is mounted from the outside in the bushing so as to clamp the connecting wire between the bushing and the plug which may serve as a center terminal. Because of the resiliency of the bushing 60, there are provided narrow ducts 63 and 64, respectively, on either side of the connecting wire 51, through which changes of pressure in the ambient air can be equalized. The rate of equalization can be adjusted at will by a proper choice of gauge of wire. It remains to be a compromise between the rate of equalization and the desired frequency response at lower frequencies. Instead of providing a pressure equalization duct through the bottom wall 41, it may in connection with other embodiments, e.g. the example shown in FIG. 4, be more suitable to establish a pressure equalization duct by means of a hole in the supporting wall or in the wall of the housing itself, which hole encompasses a bushing of a resilient, insulating material clamping a hard core and in which there are provided one or more wires between the insulating material and the hard core. The gauge of wires may be properly selected.

The advantages of the new design of a condenser microphone according to the present invention can be summarized as follows: It can be assembled in a very simple manner and a desired distance between the electrodes is easily insured; the structural members of the microphone can be manufactured seperately with the required accuracy, thus rendering superfluous the final machining of the parts in pairs for mutual adaptation; and finally it is possible to minimize problems regarding the short-term stability as differences in thermal coefficients of linear expansion are compensated for by springing of the supporting wall member instead of by sliding between structural members resulting in the avoidance of sudden changes of sensitivity.

A special version of the condenser microphone is the pre-polarized microphone, also called an electret-microphone. A microphone of this type comprises a body storing a permanent electric charge which provides the field necessary for the operation of the microphone. The body consists usually of a plastics material. In low-cost microphones the body is an integral part of the diaphragm foil unlike high-quality microphones, in which it is necessary to place the body on the backplate in order to avoid problems with the poor mechanical stability of the plastics material. Typically, the charged body, the electret member, is constituted by a polymeric coating of thickness 10 to 30 microns on the top of the stationary electrode. The applied coating results in further complications for the manufacture of condenser microphones based on the prior art technique, as this coating is applied with a certain inaccuracy regarding its thickness, such an inaccuracy, however, being of no importance for condenser microphones manufactured in accordance with the present invention, because the positioning of the backplate having the pre-polarized body attached thereon can be made with the desired exactness regarding the distance between the movable electrode and the surface of the electret member.

I claim:

1. A capacitive transducer of the type comprising:

a metallic transducer housing having two electrically conductive plates, one plate constituting a stationary electrode and the other an electrode which is movable relative to said stationary plate; said movable electrode being mounted at the end of the transducer housing, said stationary electrode being mounted internally of the transducer housing on an insulating body supporting said stationary electrode at a small distance from said movable electrode;

a substantially cylindrical supporting wall member being provided internally of said transducer housing spaced from the inner surface of said housing, one end of said supporting wall member being integrally connected to the transducer housing through a transversal wall or bottom member and the opposite end of said supporting wall member remote from said transversal wall or bottom member constituting a support for said insulating body; said supporting wall member and said insulating body being dimensioned to enable said insulating body to be mounted by being pressed into its support, the insulating body being retained therein by frictional forces.

2. A transducer as claimed in claim 1, wherein said stationary electrode and said insulating body are provided as an integral unit in the form of an insulating disc having a unilateral electrically conducting coating applied thereon.

3. A transducer according to claim 2, wherein said insulating disc has an outer cylindrical surface facing the inner surface of the supporting wall member, said outer cylindrical surface having a convex surface engaging the inner surface of the supporting wall member, said engaging surface has mirror symmetry about a plane normal to the axis of the transducer housing, said plane including a maximum diameter of the insulating disc.

4. A transducer as claimed in claim 2, wherein the stationary electrode is applied to the insulating disc as a unilateral electrically conductive coating during an evaporation process permitting a peripheral uncoated border to be left on the electrode carrying surface of the insulating disc.

5. A transducer as claimed in claim 1, wherein said stationary electrode is mounted as a separate body on a disc of an electrically insulating material.

6. A transducer according to claim 5, wherein said insulating disc has an outer cylindrical surface facing the inner surface of the supporting wall member, said outer cylindrical surface having a convex surface engaging the inner surface of the supporting wall member, said engaging surface has mirror symmetry about a plane normal to the axis of the transducer housing, said plane including a maximum diameter of the insultating disc.

7. A transducer according to claim 1, wherein a bushing of a resilient, insulating material is run through an aperture provided in the transversal wall or bottom member, said bushing clamps a hard core of an electrically conductive material, and wherein a wire including at least one strand is provided between the bushing and said hard core to provide narrow pressure equalizing ducts on either side of the wire.

8. A transducer as claimed in claim 7, wherein said hard core is a terminal, and wherein said wire is a connecting wire for the stationary electrode.

9. A capacitive transducer of the type comprising:

a metallic transducer housing having two electrically conducting plates, one plate constituting a stationary electrode and the other an electrode which is movable relative to said stationary one; said movable electrode being mounted at the end of the transducer housing, said stationary electrode being mounted internally of the transducer housing on an insulating body supporting said stationary electrode at a small distance from said movable electrode, a substantially cylindrical supporting wall member being provided internally of said transducer housing spaced from the inner surface of said housing, one end of said supporting wall member being integrally connected to the transducer housing through a transversal wall or bottom member and the opposite end of said supporting wall member remote from said transversal wall or bottom member constituting a support for said insulating body; said supporting wall member and said insulating body being dimensioned to enable said insulating body to be mounted by being inserted into its support without deformation of the wall member, the insulating body being retained in its support by means of an adhesive.

10. A transducer as claimed in claim 9, wherein said stationary electrode and said insulating body are provided as an integral unit in the form of an insulting disc having a unilateral electrically conducting coating applied thereon.

11. A transducer as claimed in claim 10, wherein the stationary electrode is applied to the insulating disc as a unilateral electrically conductive coating during an evaporation process permitting a peripheral uncoated border to be left on the electrode carrying surface of the insulating disc.

12. A transducer as claimed in claim 9, wherein said stationary electrode is mounted as a separate body on a disc of an electrically insulating material.

13. A transducer according to claim 9, wherein a bushing of a resilient, insulating, insulating material is run through an aperture provided in the transversal wall or bottom member, said bushing clamps a hard core of an electrically conductive material, and wherein a wire including at least one strand is provided between the bushing and said hard core to provide narrow pressure equalizing ducts on either side of the wire.

14. A transducer as claimed in claim 13, wherein said hard core is a terminal, and wherein said wire is a connecting wire for the stationary electrode.

* * * * *